US010060216B2

(12) United States Patent
Schroter et al.

(10) Patent No.: US 10,060,216 B2
(45) Date of Patent: Aug. 28, 2018

(54) MULTIPLE CHANNEL ROTARY ELECTRICAL CONNECTOR

(71) Applicant: Halliburton Energy Services, Inc., Houston, TX (US)

(72) Inventors: Terence A. Schroter, Edmonton (CA); Ehtisham Ishfaq, Edmonton (CA); Alben D'Silva, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 343 days.

(21) Appl. No.: 14/425,390

(22) PCT Filed: Oct. 2, 2012

(86) PCT No.: PCT/US2012/058493
§ 371 (c)(1),
(2) Date: Mar. 3, 2015

(87) PCT Pub. No.: WO2014/055068
PCT Pub. Date: Apr. 10, 2014

(65) Prior Publication Data

US 2015/0233203 A1 Aug. 20, 2015

(51) Int. Cl.
*E21B 33/038* (2006.01)
*H01R 39/08* (2006.01)
(Continued)

(52) U.S. Cl.
CPC ..... *E21B 33/0385* (2013.01); *E21B 7/06* (2013.01); *E21B 41/00* (2013.01); *H01R 39/08* (2013.01); *H01R 39/38* (2013.01); *H01R 39/381* (2013.01)

(58) Field of Classification Search
None
See application file for complete search history.

(56) References Cited

U.S. PATENT DOCUMENTS 1,873,042 A * 8/1932 Rohrdanz ..... H01R 35/04 439/18
2,339,274 A * 1/1944 Kothny ..... E21B 4/04 166/66.4
(Continued)

FOREIGN PATENT DOCUMENTS

EP 0716481 A2 6/1996
RU 2367765 C2 9/2009
(Continued)

OTHER PUBLICATIONS

International Search Report and Written Opinion of PCT Application No. PCT/US2012/058493 dated Jan. 10, 2013: pp. 1-11.

*Primary Examiner* — Shane Bomar
(74) *Attorney, Agent, or Firm* — Chamberlain Hrdlicka

(57) ABSTRACT

A multiple channel rotary electrical connector can include multiple first contacts which are radially spaced apart from each other, and multiple second contacts which electrically contact respective ones of the first contacts while there is relative rotation between the first and second contacts. The second contacts may be radially spaced apart from each other. A well tool can include one section which rotates relative to another section of the well tool, and a multiple channel rotary electrical connector which includes multiple annular-shaped contacts that rotate relative to each other. A method of operating a well tool in a subterranean well can include producing relative rotation between sections of the well tool, and communicating multiple channels of electrical signals between the sections while there is relative rotation between the sections. The communicating can include electrically contacting multiple annular-shaped contacts with each other.

37 Claims, 8 Drawing Sheets

(51) Int. Cl.

| | |
|---|---|
| ***H01R 39/38*** | (2006.01) |
| ***E21B 7/06*** | (2006.01) |
| ***E21B 41/00*** | (2006.01) |

(56) References Cited

U.S. PATENT DOCUMENTS

| | | | | | |
|---|---|---|---|---|---|
| 4,304,452 | A | * | 12/1981 | Kiefer | H01R 13/523 439/199 |
| 4,904,190 | A | | 2/1990 | Plocek et al. | |
| 5,468,153 | A | * | 11/1995 | Brown | E21B 17/028 439/13 |
| 5,588,843 | A | | 12/1996 | Mohi | |
| 6,299,454 | B1 | | 10/2001 | Henderson et al. | |
| 6,367,564 | B1 | * | 4/2002 | Mills | E21B 17/028 175/320 |
| 7,052,297 | B2 | * | 5/2006 | Panzar | H01R 13/187 439/169 |
| 7,843,023 | B2 | * | 11/2010 | Naito | H01H 59/0009 257/414 |
| 7,887,333 | B1 | | 2/2011 | Justin et al. | |
| 2005/0026462 | A1 | | 2/2005 | Johnson et al. | |
| 2010/0170671 | A1 | | 7/2010 | Sihler | |
| 2010/0200295 | A1 | | 8/2010 | Schimanski et al. | |
| 2011/0017473 | A1 | | 1/2011 | Clarkson et al. | |

FOREIGN PATENT DOCUMENTS

| | | | |
|---|---|---|---|
| RU | 2456446 | C1 | 7/2012 |
| SU | 813563 | A1 | 3/1981 |
| SU | 974940 | A1 | 11/1982 |
| SU | 1725300 | A1 | 4/1992 |

* cited by examiner

MULTIPLE CHANNEL ROTARY ELECTRICAL CONNECTOR

TECHNICAL FIELD

This disclosure relates generally to equipment utilized and operations performed in conjunction with a subterranean well and, in one example described below, more particularly provides a multiple channel rotary electrical connector.

BACKGROUND

It is sometimes useful to be able to communicate electrical signals, power, etc., between a rotating section and a nonrotating section of a well tool, or between two rotating sections, or between two well tools, etc. For example, in drilling operations, sensors and/or actuators may be located below or in a drilling motor, and it may be desired to communicate sensor measurements to a nonrotating measurement-while-drilling (MWD) tool for telemetering to the surface, or it may be desired to transmit commands and/or electrical power to an actuator across the drilling motor (e.g., to adjust a steering tool).

Therefore, it will be appreciated that improvements are continually needed in the art of communicating electrical signals, power, etc., between sections of a well tools which rotate relative to one another.

DETAILED DESCRIPTION

Figure 1:
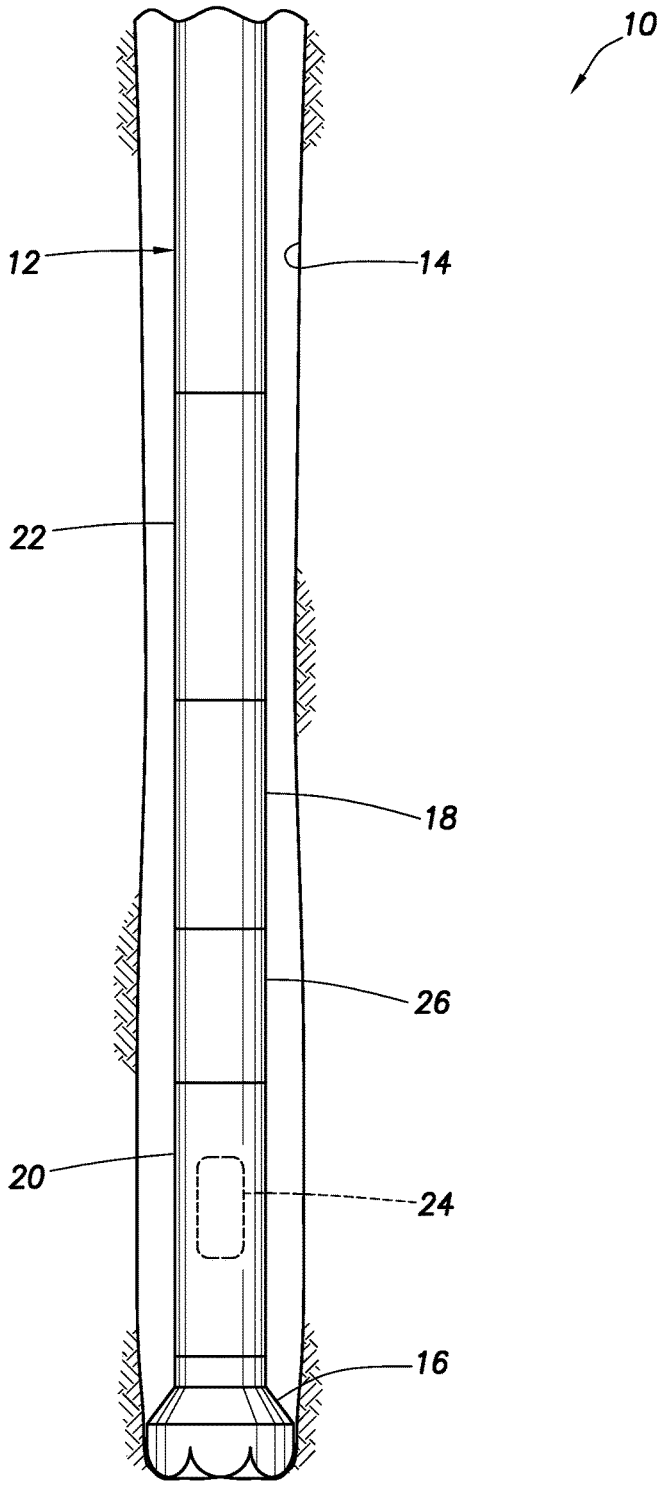
FIG. 1 is a representative partially cross-sectional view of a well system and associated method which can embody principles of this disclosure.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a drill string 12 is used to drill a wellbore 14 into the earth. For this purpose, the drill string

12 includes a drill bit 16. The drill bit 16 is rotated by a drilling motor 18 (such as, a Moineau-type positive displacement "mud" motor, a drilling turbine, etc.).

A well tool 20 is used to steer the drill bit 16, so that the wellbore 14 is drilled in a desired direction (e.g., with a desired azimuth, inclination, etc.). A shaft (not visible in FIG. 1, see FIG. 2) is connected to the drill bit 16, is rotated by the drilling motor 18, and is deflected by the tool 20, so that the drill bit drills the wellbore in the desired direction.

In this example, the tool 20 includes both rotating sections and nonrotating sections (e.g., the rotating shaft and a nonrotating outer housing). It is desired to communicate electrical signals (such as, data, commands, power, etc.) between the rotating and nonrotating sections of the tool 20. For example, sensor data may be communicated to a measurement-while-drilling (MWD) and telemetry tool 22 for processing and telemetering to a remote location (e.g., a data acquisition system at the earth's surface, a sea floor location, a floating rig, etc.), and/or electrical power may be supplied to actuator(s) of the tool 20 in order to deflect the shaft therein.

For this purpose, the tool 20 includes a multiple channel rotary electrical connector 24. However, it should be clearly understood that it is not necessary for the connector 24 to be used in the well tool 20 which steers the drill bit 16, or for any particular types of electrical signals to be communicated between any particular rotating or nonrotating sections of one or more well tools.

Multiple channels may be desirable, for example, to separate electrical power, data and command channels. Another use for the multiple channels may be to provide redundancy.

The scope of this disclosure is not limited to a particular arrangement of drilling tools in a drill string, and is not limited to use in a drilling operation at all. The system 10, drill string 12 and tool 20 are only one example of a wide variety of different uses for the principles described herein.

Relative rotation between well tool sections can be intermittent, periodic, continuous, etc. The multiple channel rotary connector 24 can also be used to transmit electrical signals (power, data, commands, etc.) between well tool sections when there is no relative rotation between the well tool sections.

Figure 2:
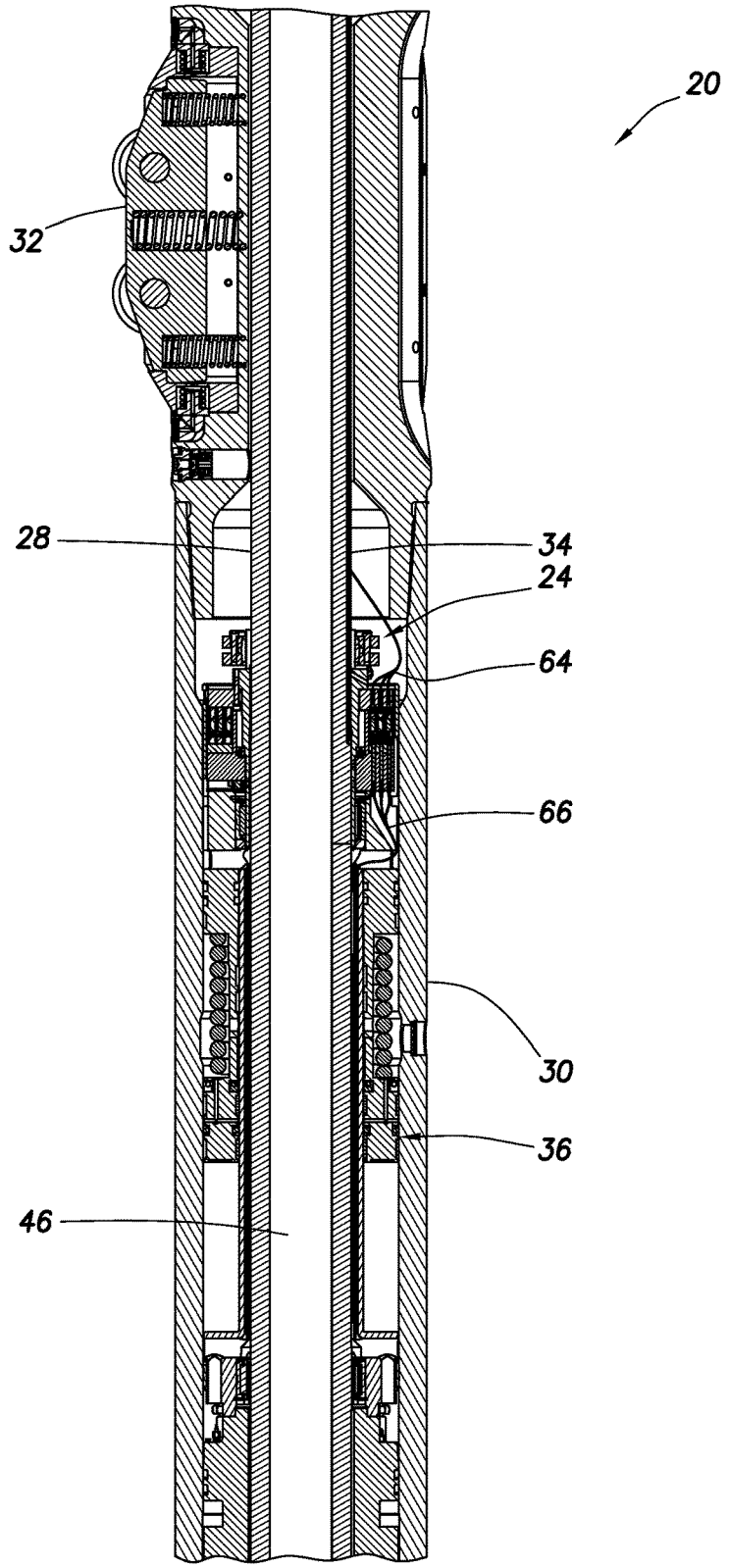
FIG. 2 is an enlarged scale representative cross-sectional view of a well tool which can embody principles of this disclosure.

Referring additionally now to FIG. 2, an enlarged scale cross-sectional view of a longitudinal section of the tool 20 is representatively illustrated. The tool 20 in this example is similar in most respects to a GEO-PILOT™ rotary steerable tool marketed by Halliburton Energy Services, Inc. of Houston, Tex. USA, although other types of well tools (such as, the drilling motor 18 or a bearing package 26 depicted in FIG. 1, an orienting tool, etc.) can incorporate the principles of this disclosure.

In the FIG. 2 example, a shaft 28 is driven by the drilling motor 18. An outer housing 30 is restricted from rotary movement relative to the wellbore 14 by an outwardly extendable gripping reference assembly 32.

Although only one each of the shaft 28, outer housing 30 and reference assembly 32 is depicted in the FIG. 2 illustration, any number of these elements may be provided, and any of these elements may be made up of a combination of multiple components. Thus, the scope of this disclosure is not limited to any particular number, arrangement or configuration of elements of the well tool 20 as depicted in the drawings or described herein.

A flow passage 46 extends longitudinally though the shaft 28. In typical drilling operations, a drilling fluid is flowed downwardly through the passage 46 in the tool 20.

The shaft 28 includes a conduit or passageway 34 for routing lines (e.g., electrical wires or other conductors) upward from the rotary electrical connector 24. The connector 24 provides a way of electrically connecting electrical lines 64 in the passageway 34 on the rotating shaft 28 to electrical lines 66 in the nonrotating outer housing 30.

However, it is not necessary for the outer housing 30 to be nonrotating, or for the shaft 28 to be rotating. In other examples, an outer element could rotate relative to an inner element, or one element may not be "inner" or "outer" relative to another element (e.g., the elements could be the same dimension and coaxially aligned, etc.). Thus, the scope of this disclosure is not limited to any particular details of the connector 24 depicted in the drawings or described herein.

The connector 24 in the FIG. 2 example is coupled to a pressure compensator 36. Detailed views of the connector 24 and compensator 36 are representatively illustrated in FIGS. 3 & 4. In other examples, the connector 24 could be coupled to other types of devices, or the connector could be used separate from other devices.

Figure 3:
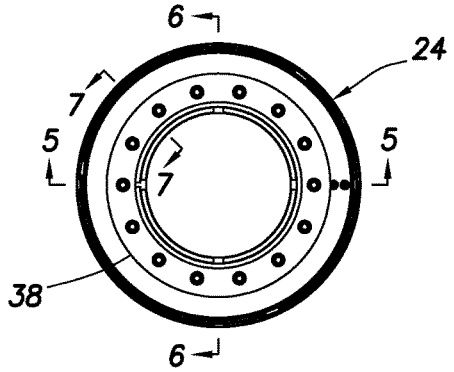
FIGS. 3 & 4 are representative end and side views of a multiple channel rotary electrical connector which can embody principles of this disclosure.
Figure 4:
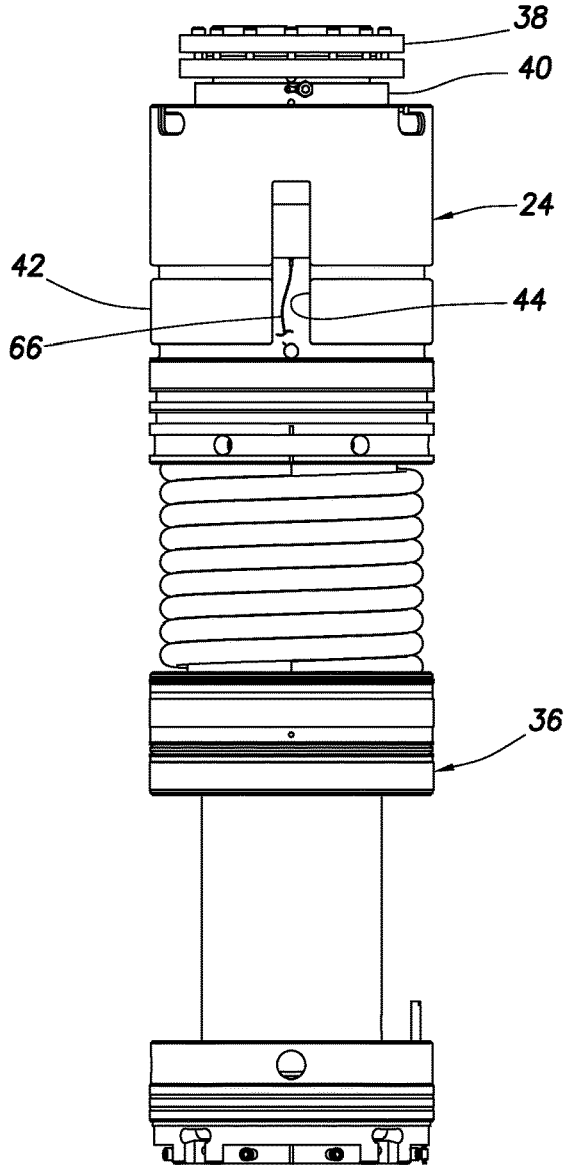

In FIGS. 3 & 4, a clamp 38 can be seen. The clamp 38 is used to secure a section 40 of the connector 24 to the shaft 28, so that it rotates with the shaft. Another section 42 of the connector 24 is secured relative to the outer housing 30, and does not rotate. The section 42 includes a conduit or passageway 44 for routing lines 66 (such as, electrical wires or other conductors) downward from the connector 24.

The sections 40, 42 may be secured to the respective shaft 28 and housing 30 by any means, including but not limited to, adhesives, upsets, fasteners, etc.

Figure 5:
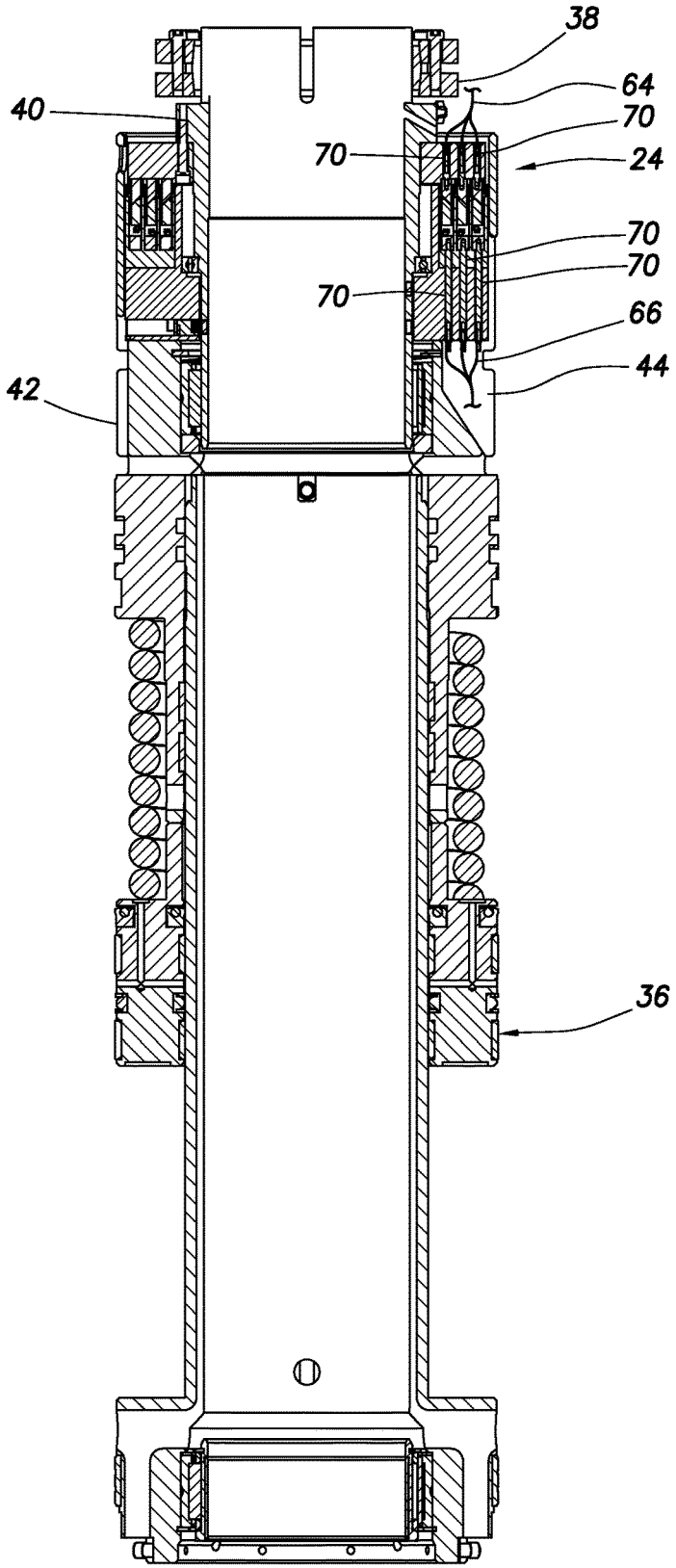
FIG. 5 is a representative cross-sectional view of the multiple channel rotary electrical connector, taken along line 5-5 of FIG. 3.
Figure 6:
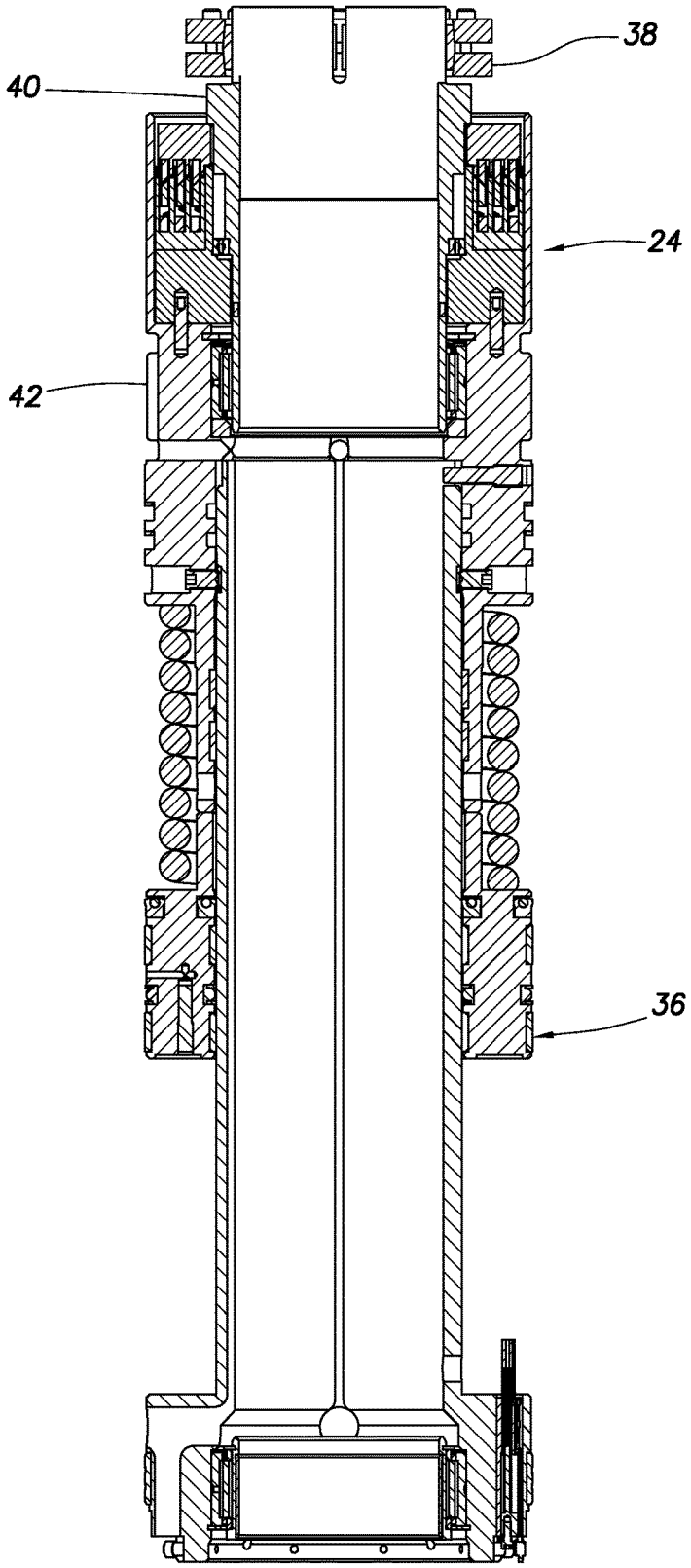
FIG. 6 is a representative cross-sectional view of the multiple channel rotary electrical connector, taken along line 6-6 of FIG. 3.

Cross-sectional views of the connector 24 and compensator 36 are representatively illustrated in FIGS. 5 & 6. The pressure compensator 36 compensates for pressure variations in a lubricant oil bath in which the connector 24 is contained. This oil bath lubricates contact faces of the connector 24 and aids with relative rotation between the sections 40, 42.

Figure 7:
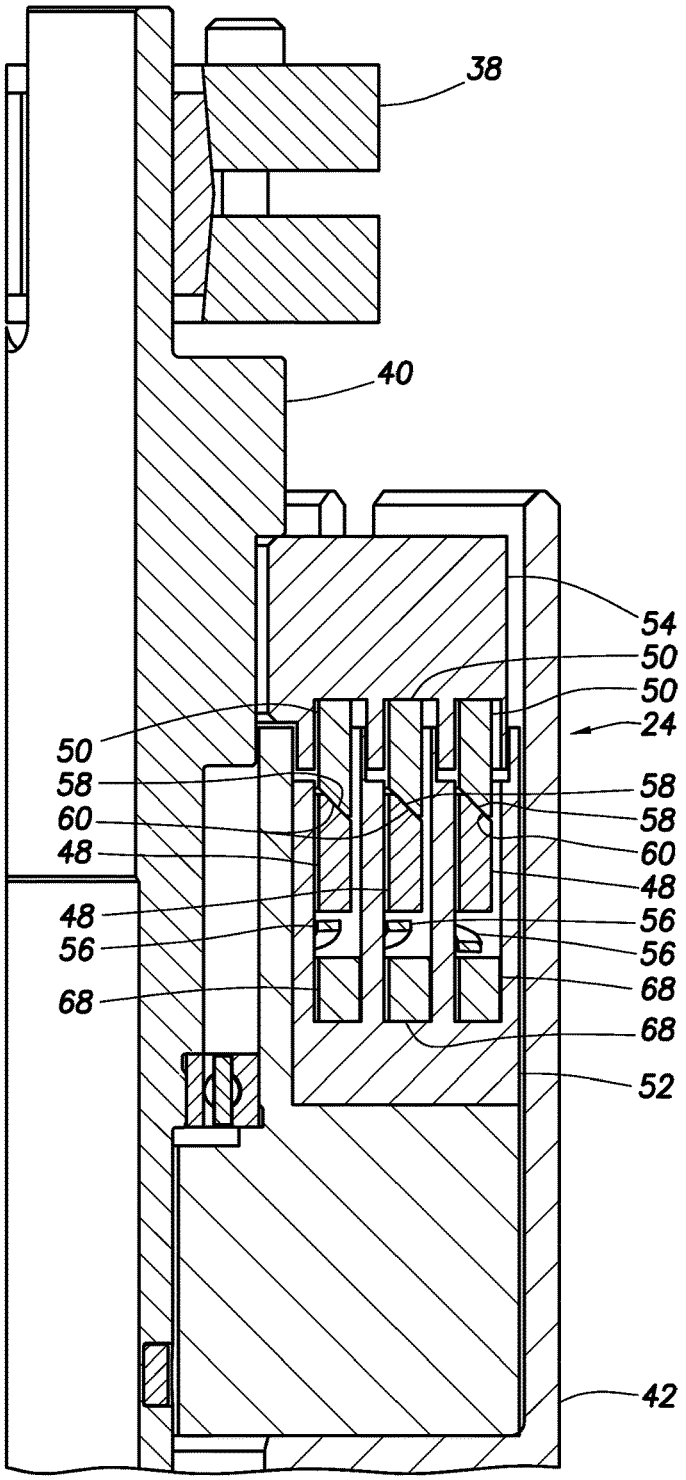
FIG. 7 is a further enlarged scale representative cross-sectional view of the multiple channel rotary electrical connector, taken along line 7-7 of FIG. 3.

An enlarged scale cross-sectional view of the connector 24 is representatively illustrated in FIG. 7. In FIG. 7 it may be clearly seen that a series of annular-shaped and radially spaced apart electrical contacts 48 are in electrical contact with another series of annular-shaped and radially spaced apart electrical contacts 50. The contacts 48 are secured (e.g., in insulator 52) relative to the nonrotating section 42, and the contacts 50 are secured (e.g., in insulator 54) relative to the rotating section 40. Thus, the contacts 50 rotate relative to the contacts 48.

The contacts 48, 50 in this example are preferably carburized for extended service life. The insulators 52, 54 preferably comprise a poly-ether-ether-ketone (PEEK) material. However, the scope of this disclosure is not limited to any particular materials used for the contacts 48, 50 or insulators 52, 54.

The contacts 48 are biased into contact with the contacts 50 by wave springs 56. The wave springs 56 desirably resist axial displacement of the contacts 48 out of contact with the contacts 50, and also conduct electrical signals between the contacts 48 and the electrical lines in the passageway 44. The springs 56 desirably resist loss of electrical contact due to, for example, vibration or shock experienced by the well tool 20 during a drilling operation. However, the scope of this disclosure is not limited to use of any particular type of biasing device, or to biasing devices which also conduct electrical signals.

In the FIG. 7 example, the contacts 48, 50 have complementarily shaped inclined faces 58, 60 which electrically contact each other. The inclined faces 58, 60 are frustoconical in shape.

One benefit of the inclined faces is that they operate to center the contacts 48, 50 with respect to each other, so that respective sets of the contacts are maintained coaxial with each other. Another benefit of the inclined faces 58, 60 is that they will tend to remain in contact with each other, even if the connector 24 becomes distorted (e.g., due to bending of the outer housing 30, bending of the shaft 28, etc.).

Rings 68 transmit power, data, commands, etc. between the springs 56 and the lines 66. Threaded and/or crimped connectors 70 (see FIG. 5) may be used to connect the lines 66 to the rings 68. Similar connectors 70 may be used to connect the contacts 50 to the lines 64.

Figure 8:
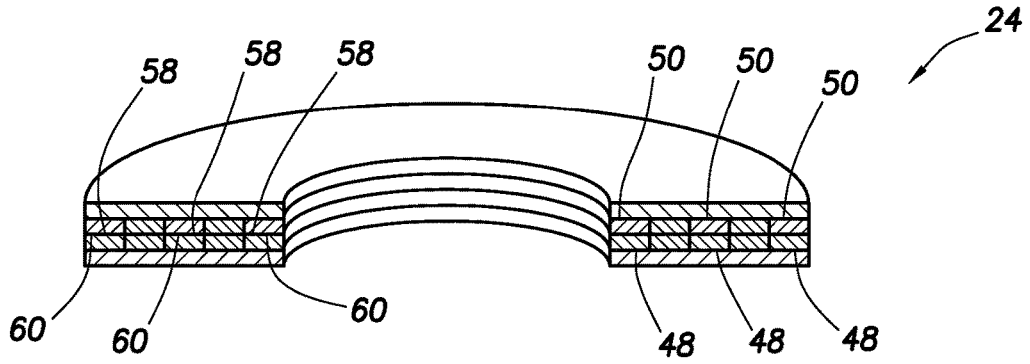
FIGS. 8 & 9 are representative cross-sectional views of contact configurations which may be used in the multiple channel rotary electrical connector.
Figure 9:
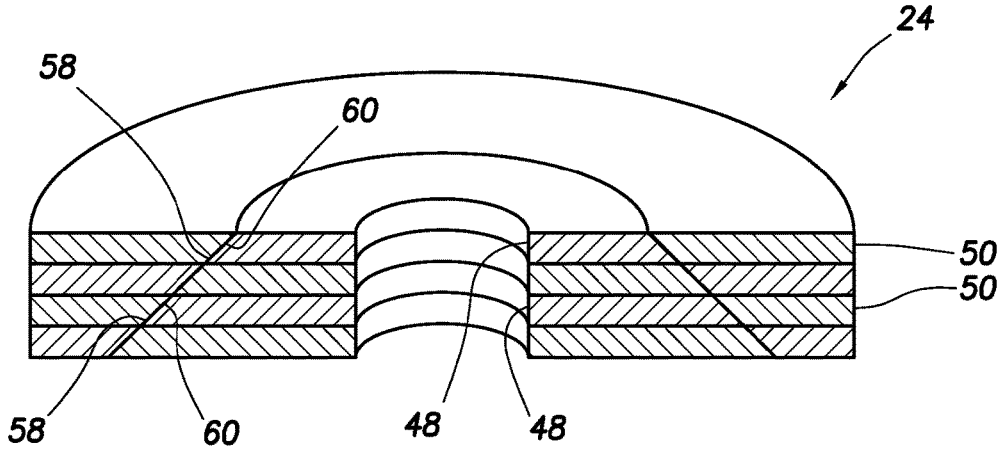

Referring additionally now to FIGS. 8 & 9, additional examples of arrangements of the contacts 48, 50 are representatively illustrated. These examples demonstrate that a variety of different configurations of the connector 24 are possible, and so the scope of this disclosure is not limited to any particular number, arrangement or configuration of the contacts 48, 50.

In FIG. 8, the faces 58, 60 of the contacts 48, 50 are not inclined. This arrangement may be used, for example, at the center of a rotating housing, e.g., to transmit power, data, commands, etc. through a bore of the housing.

In FIG. 9, the faces 58, 60 are inclined, and are arranged in a conical shape. In addition, the contacts 48, 50 contact each other in a radial direction, instead of in an axial direction as in the examples of FIGS. 7 & 8.

One advantage of the conical arrangement of the FIG. 9 example is that the conical shape tends to coaxially align all of the contacts 48, 50 together. However, the scope of this disclosure is not limited to contacts which are coaxially aligned.

The FIG. 9 configuration may be used at a contact face between two housings with relative rotation between the housings. In another example, the inner contacts 48 could be secured to a shaft, and the outer contacts 50 could be secured to a housing, with relative rotation between the shaft and housing. In this example, the contacts 48, 50 would be used to transmit power, data, commands, etc. in a radial direction via the connector 24.

Figure 10:
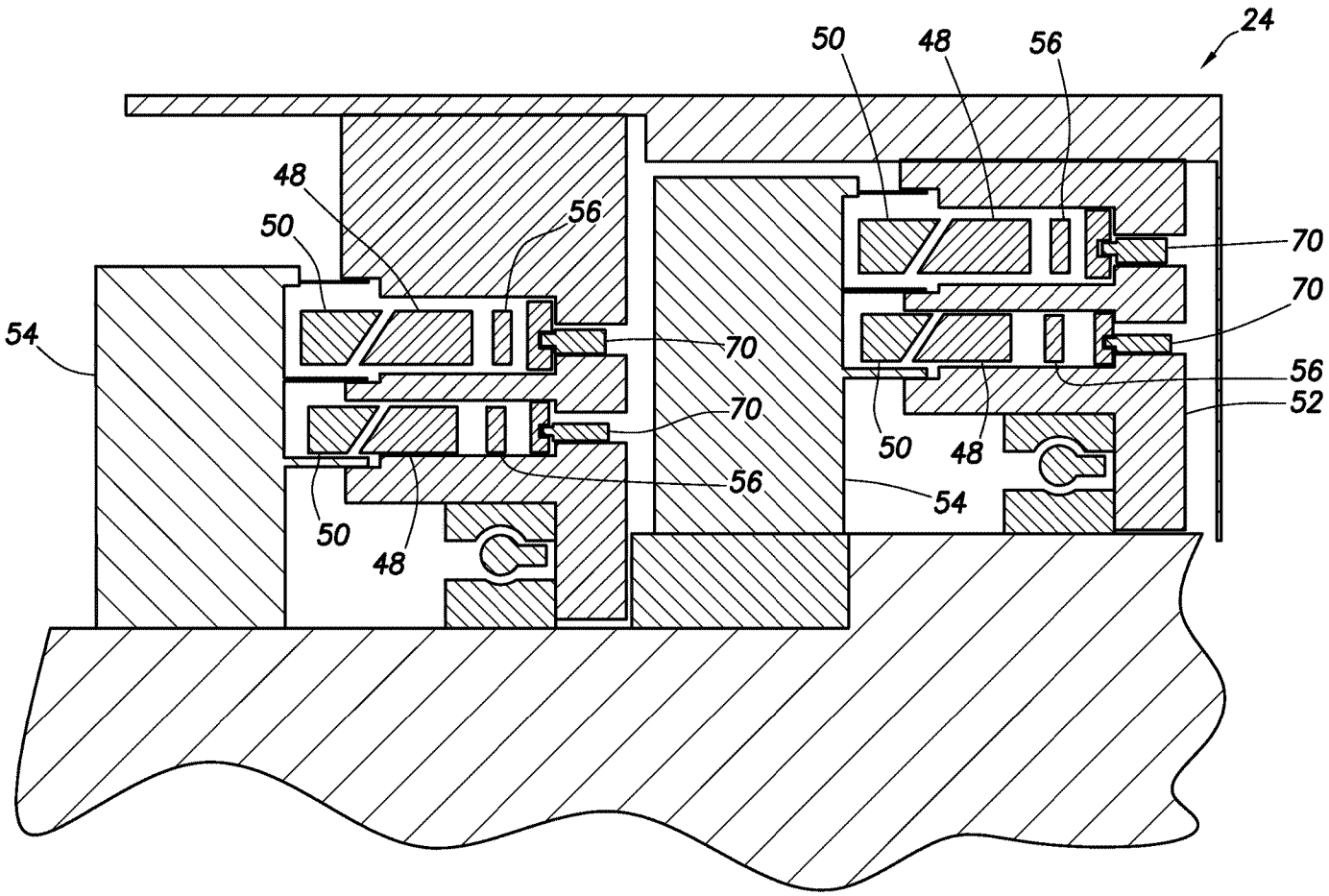
FIG. 10 is a cross-sectional view of another configuration of the multiple channel rotary electrical connector.

Referring additionally now to FIG. 10, another example of the electrical connector 24 is representatively illustrated. In this example, the connector 24 includes multiple sets of the contacts 48, 50.

In this example, the sets of contacts 48, 50 are both radially and axially offset with respect to each other. This example demonstrates that any number or arrangement of sets of contacts 48, 50 may be used, in keeping with the scope of this disclosure.

It may now be fully appreciated that the above description provides significant benefits to the art of communicating electrical signals, power, etc., between sections of a well tool which rotate relative to one another. In the tool 20 described above, the connector 24 provides for multiple channels of electrical communication between the rotating section 40 and the nonrotating section 42, in a manner that is capable of withstanding relatively high shock or vibration loading (e.g., with the wave springs 56 firmly biasing the contacts 48, 50 into contact with each other), and is capable of withstanding deformation of the associated elements (e.g., the outer housing 30 and shaft 28) of the tool.

The connector 24 can transmit electrical signals (power, data, commends, etc.) between well tool sections having relative rotation between the sections. The sections could correspond to a shaft and an outer housing, two housings, two shafts, or any other well tools sections having relative rotation, whether in a single well tool or in multiple well tools.

The electrical signal transmission is preferably through metal to metal face contact. A set of metal contact rings, discs or sleeves are used, which mate to a matching set of rings, discs or sleeves.

Each set of connectors includes a preload, due to a spring 56, to ensure positive contact while rotating. The spring 56 also allows resistance to shock or vibration. The metal contacts can be made from carburized steel to allow high wear resistance and good electrical contact.

In one example described above, one side of the multi-channel electrical connector 24 is installed into a stationary bulkhead and is made up of a set of carburized steel conical contacts 48 connected to a set of copper rings 68 via springs 56. The copper rings 68 are provided with crimp connectors 70 to facilitate connection to other electrical components of the well tool 20. The crimp connectors 70 are preferably threaded into the rings 68.

On the other side of the connector 24, carburized steel conical "cup" contacts 50 are installed in the insulator 54, which is secured to the rotating shaft 28. The "cup" contacts 50 have crimp connectors 70 threaded into them. The springs 56 exert a preload between the contacts 48, 50 to ensure good electrical contact.

Instead of the crimp connectors 70, soldered connections could be provided. However, the soldered connections should be capable of withstanding expected temperatures in operation.

Preferably, the contacts 48, 50 are provided with channels to allow the lubricant oil bath to cool the metal-to-metal faces between the contacts. The contacts 48, 50, springs 56 and/or rings 68 may be provided with upsets or impressions to allow for transmission of torque resulting from the relative rotation and metal to metal face contact between the contacts 48, 50.

The connector 24 may be used to transmit electrical signals in a longitudinal and/or radial direction between any well tool sections. The connector 24 may be used, e.g., in an external housing, in a bore of a tool, on a face between two housings, or between a shaft and an outer housing. The connector 24 can be used to electrically connect different tools together, either for an application where relative rotation is only while two housings are threaded together, or when both housings are periodically or continuously rotated with respect to one another.

The shape of the cones, discs or sleeves allow for centralization and for preload to be applied, to ensure positive contact. The face to face contact is preferably a carburized steel to carburized steel contact that is highly resistant to wear.

With the connector 24 being comprised mainly of steel and PEEK components, and the lines 64, 66 being crimped via the connectors 70, the connector 24 in some examples should be capable of withstanding temperatures downhole of greater than 200 degrees C. The preload provided by the springs 56 can in some examples withstand up to approximately 200 g due to shock and vibration.

Preferably, if one side of the connector 24 is stationary, that side has the conical contacts 50, which centralize and contain the "cup" contacts 48 to ensure positive contact. Electrical signals can be reliably transmitted in some examples at up to 300 revolutions per minute, and with up to 200 g vibration, with virtually no electrical noise generated.

With the contacts 48, 50 made of carburized steel, and the preload force kept relatively low, wear on the faces of the contacts will preferably be minimal, even after 200 hours of operation. The contacts 48, 50 are preferably relatively simple geometric shapes that are inexpensive and relatively quick to manufacture. Overall, the connector 24 requires little maintenance, and is compact and durable.

Although examples described above are for use in a well, other applications of the principles of this disclosure are possible. For example, the connector 24 could be used in the electrical power and communications industry.

A well tool 20 is provided to the art by the above disclosure. In one example, the tool 20 can include a first section 40 which rotates relative to a second section 42 of the well tool, and a multiple channel rotary electrical connector 24 which includes multiple annular-shaped first contacts 50 that rotate relative to multiple annular-shaped second contacts 48.

The well tool 20 can also include a flow passage 46 which extends longitudinally through the well tool 20. The first and second contacts 48, 50 may encircle the flow passage 46.

Each of the first contacts 50 may include a first inclined face 60 which contacts a second inclined face 58 of a respective one of the second contacts 48. The first inclined faces 60 can be arranged in a conical configuration.

The first contacts 50 may be radially and/or axially spaced apart.

The first contacts 50 may be both radially and axially offset from each other (e.g., as in the FIG. 9 example).

At least one of the first contacts 50 may encircle another of the first contacts 50.

The first section 40 can be secured to a shaft 28 driven by a drilling motor 18.

The first and second sections 40, 42 can be included in a rotary steering tool 20 which steers a drill bit 16.

A biasing device (such as the springs 56) can bias the first and second contacts 48, 50 into contact with each other. Electrical current can flow through the biasing device(s) 56.

A multiple channel rotary electrical connector 24 is also provided to the art by the above disclosure. In one example, the electrical connector 24 can include multiple first contacts 48 which are radially spaced apart from each other, and multiple second contacts 50 which electrically contact respective ones of the first contacts 48 while there is relative rotation between the first and second contacts 48, 50. The second contacts 50 may be radially spaced apart from each other.

A method of operating a well tool 20 in a subterranean well is also described above. In one example, the method can comprise: producing relative rotation between first and second sections 40, 42 of the well tool 20; and communicating multiple channels of electrical signals between the first and second sections 40, 42 while there is relative rotation between the first and second sections 40, 42. The communicating step can include electrically contacting multiple annular-shaped first contacts 48 with respective ones of multiple annular-shaped second contacts 50.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well tool, comprising:

a first section which rotates relative to a second section of the well tool;

a multiple channel rotary electrical connector which includes multiple annular-shaped first contacts that rotate relative to multiple annular-shaped second contacts; and a fluid flow passage which extends longitudinally through the well tool, and wherein the first and second contacts encircle the fluid flow passage.

2. The well tool of claim 1, wherein each of the first contacts includes a first inclined face which contacts a second inclined face of a respective one of the second contacts.

3. The well tool of claim 2, wherein the first inclined faces are arranged in a conical configuration.

4. The well tool of claim 2, wherein the first inclined faces centralize the second inclined faces.

5. The well tool of claim 1, wherein the first contacts are radially spaced apart.

6. The well tool of claim 1, wherein the first contacts are axially spaced apart.

7. The well tool of claim 1, wherein the first contacts are both radially and axially offset from each other.

8. The well tool of claim 1, wherein at least one of the first contacts encircles another of the first contacts.

9. The well tool of claim 1, wherein the first section is secured to a shaft driven by a drilling motor.

10. The well tool of claim 1, wherein the first and second sections are included in a rotary steering tool which steers a drill bit.

11. The well tool of claim 1, wherein the connector transmits electrical signals without interruption.

12. The well tool of claim 1, further comprising a biasing device which biases the first and second contacts into contact with each other.

13. The well tool of claim 12, wherein electrical signals are transmitted through the biasing device.

14. A multiple channel rotary electrical connector, comprising:

multiple first contacts which are radially spaced apart from each other; and multiple second contacts which electrically contact respective ones of the first contacts while there is relative rotation between the first and second contacts, wherein the second contacts are radially spaced apart from each other, and wherein the first and second contacts encircle a fluid flow passage.

15. The electrical connector of claim 14, wherein each of the first and second contacts is annular-shaped.

16. The electrical connector of claim 14, wherein each of the first contacts includes a first inclined face which contacts a second inclined face of a respective one of the second contacts.

17. The electrical connector of claim 16, wherein the first inclined faces are arranged in a conical configuration.

18. The electrical connector of claim 16, wherein the first inclined faces centralize the second inclined faces.

19. The electrical connector of claim 14, wherein the first contacts are axially spaced apart.

20. The electrical connector of claim 14, wherein the first contacts are both radially and axially offset from each other.

21. The electrical connector of claim 14, wherein at least one of the first contacts encircles another of the first contacts.

22. The electrical connector of claim 14, wherein the connector transmits electrical signals without interruption.

23. The electrical connector of claim 14, further comprising a biasing device which biases the first and second contacts into contact with each other.

24. The electrical connector of claim 23, wherein electrical signals are transmitted through the biasing device.

25. A method of operating at least one well tool in a subterranean well, the method comprising:

producing relative rotation between first and second well tool sections;

communicating multiple channels of electrical signals between the first and second sections while there is relative rotation between the first and second sections, the communicating comprising electrically contacting multiple annular-shaped first contacts with respective ones of multiple annular-shaped second contacts; and encircling, by the first and second contacts, a fluid flow passage which extends longitudinally through the well tool.

26. The method of claim 25, wherein the contacting further comprises a first inclined face of each of the first contacts contacting a second inclined face of a respective one of the second contacts.

27. The method of claim 26, wherein the first inclined faces are arranged in a conical configuration.

28. The method of claim 26, wherein the first inclined faces centralize the second inclined faces.

29. The method of claim 25, wherein the first contacts are radially spaced apart.

30. The method of claim 25, wherein the first contacts are axially spaced apart.

31. The method of claim 25, wherein the first contacts are both radially and axially offset from each other.

32. The method of claim 25, wherein at least one of the first contacts encircles another of the first contacts.

33. The method of claim 25, wherein the first section is secured to a shaft driven by a drilling motor.

34. The method of claim 25, wherein the first and second sections are included in a rotary steering tool which steers a drill bit.

35. The method of claim 25, wherein the connector transmits electrical signals without interruption.

36. The method of claim 25, further comprising a biasing device biasing the first and second contacts into contact with each other.

37. The method of claim 36, further comprising transmitting electrical signals through the biasing device.

* * * * *